US007151074B1

(12) United States Patent
Date et al.

(10) Patent No.: US 7,151,074 B1
(45) Date of Patent: Dec. 19, 2006

(54) REVERSIBLE HEAT-SENSITIVE PAPER AND METHODS FOR WRITING INFORMATION

(75) Inventors: Munehiro Date, Wako (JP); Mitsuru Kaimai, Tokyo (JP); Yasurou Yokota, Tokyo (JP)

(73) Assignees: Riken, Saitama (JP); Chromic Co., Ltd., Tokyo (JP)

( * ) Notice: Subject to any disclaimer, the term of this patent is extended or adjusted under 35 U.S.C. 154(b) by 0 days.

(21) Appl. No.: 09/434,498

(22) Filed: Nov. 5, 1999

(30) Foreign Application Priority Data

Nov. 5, 1998 (JP) ..... 10-314856

(51) Int. Cl.
*B41M 5/20* (2006.01)

(52) U.S. Cl. ..... 503/201; 430/200; 503/216

(58) Field of Classification Search ..... 503/201, 503/216, 217, 209; 430/200
See application file for complete search history.

(56) References Cited

U.S. PATENT DOCUMENTS

| | | | | |
|---|---|---|---|---|
| 5,395,433 | A * | 3/1995 | Maruyama et al. | 106/21 A |
| 5,407,890 | A | 4/1995 | Ishikawa | |
| 5,521,138 | A | 5/1996 | Shimada et al. | |
| 5,547,500 | A | 8/1996 | Tsutsui | |
| 5,663,115 | A | 9/1997 | Naito et al. | |
| 5,703,005 | A | 12/1997 | Torii et al. | |
| 5,981,115 | A * | 11/1999 | Furuya et al. | 430/19 |
| 6,184,180 | B1 * | 2/2001 | Maruyama et al. | 503/216 |

FOREIGN PATENT DOCUMENTS

| | | | |
|---|---|---|---|
| DE | 196 27 185 | A1 | 1/1997 |
| EP | 0 600 441 | A1 | 6/1994 |
| GB | 2 135 466 | A | 8/1984 |
| GB | 2 320 582 | A | 6/1998 |
| GB | 2 326 726 | A | 12/1998 |
| JP | 06-210954 | A2 | 8/1994 |
| JP | 07-068934 | | 3/1995 |
| JP | 07-108761 | | 4/1995 |
| JP | 07-164746 | | 6/1995 |
| JP | 07-179043 | | 7/1995 |
| JP | 07-214907 | | 8/1995 |

OTHER PUBLICATIONS

Final Program and Proceedings—The 9th International Congress on Advances in Non-Impact Printing Technologies/Japan Hardcopy '93—(pp. 413-416).

* cited by examiner

*Primary Examiner*—Bruce H. Hess
(74) *Attorney, Agent, or Firm*—Griffin & Szipl, P.C.

(57) ABSTRACT

A reversible heat-sensitive layer 1*a* provided with an electron donative precursor and a reversible developer that colors and discolors the precursor, is provided on the surface of a base, and the reversible heat-sensitive recording layer is heated previously to a molten state and then quickly cooled to a solid colored state. Using this reversible heat-sensitive paper (reversible writing heat-sensitive paper), the reversible heat-sensitive recording layer is heated during operation to a color-erasing temperature range lower than the melting temperature of the layer, thereby, a heated part is discolored and written with information. Thus, the life of the reversible heat-sensitive layer can be prolonged and information can be written with weak light.

4 Claims, 5 Drawing Sheets

REVERSIBLE HEAT-SENSITIVE PAPER AND METHODS FOR WRITING INFORMATION

This application claims priority on Japanese Patent Application Number 10-314856, filed Nov. 5, 1998, the entire disclosure of which is incorporated herein by reference.

BACKGROUND OF THE INVENTION

1. Technical Field of the Invention

The present invention relates to reversible heat-sensitive paper and methods for writing information on it.

2. Description of Prior Art

A sheet of conventional heat-sensitive recording paper is composed of a supporting base (for example, a paper sheet) provided with a heat-sensitive recording layer on the base, and when the sheet is heated by a heating head, heating pen, laser light, etc., information on image, barcode, etc. is written on the heat sensitive recording layer. However, such heat-sensitive recording paper has a disadvantage in that once information is written, the information cannot be erased, so the paper cannot be used again.

To solve this problem, heat-sensitive recording materials with a reversible property were invented and patent applied (for instance, laid-open Japanese patent No. 179043/1995). The reversible heat-sensitive recording material according to the laid-open Japanese patent No. 179043/1995 normally contains a colorless or light-colored electron donative dyestuff precursor, and a special electron acceptive compound that reversibly changes the color of the dyestuff precursor when the compound is heated, and the material can create and erase an image with a high contrast and can maintain images stably over a wide range of erasing temperatures, as advantageous characteristics.

One of the reversible heat-sensitive papers developed using such a reversible heat-sensitive recording material is, for example, leuco-based rewritable heat-sensitive paper using an electron donative dyestuff precursor. The electron donative dyestuff precursor is shown in FIG. 1; a lactone ring in the molecule opens in an acidic atmosphere and the precursor is colored, and by removing the acidic atmosphere, the lactone ring closes to resume a colorless state. The leuco-based rewritable heat-sensitive paper is combined with the electron donative dyestuff precursor and a reversible developer, where the reversible developer can reversibly create and erase a color through reactions with the electron donative dyestuff precursor. Typical reversible developers include, for example, a phenol-based compound with long chains in an alkyl group.

FIG. 2 shows a coloring and uncoloring model. In FIG. 2, the electron donative dyestuff precursor and the reversible developer in a color-erased state (lower left) are heated, both are fused into a colored state (top), and when they are cooled quickly, the mix is solidified in a near-fusion state, thereby a solid colored state (lower right) is maintained. When the mix is gradually cooled, conversely, the electron donative dyestuff precursor and the reversible developer return to an erased state. Therefore, they can reverse to color or uncolor by quickly or gradually cooling the mix, respectively, after fusion. In addition, a solid mix in a colored state can be transited to the original uncolored state by maintaining the mix for a predetermined time in a temperature range slightly lower than the melting point.

FIG. 3 is a typical sectional view of a reversible heat-sensitive paper 4 used conventionally for coloring and uncoloring with light. In FIG. 3, the numerals represent a base medium by 1, a photo-thermal conversion layer by 2, and a protection film by 3. On the surface of the thermal sensitive paper 1, is formed a reversible heat-sensitive recording layer 1*a* consisting of an electron donative dyestuff precursor and a reversible developer, formed by a coating method. The opto-thermal conversion layer 2 contains a substance that converts light with a predetermined wavelength into heat, and the substance is normally applied to the surface of the heat-sensitive paper 1, but the substance may also be dispersed in the reversible heat sensitive recording layer. In the opto-thermal conversion layer 2, an organic coloring matter that absorbs selectively light with predetermined wavelengths is normally used. The protection film 3 is a transparent film that protects the surface of the heat-sensitive paper 1 and the opto-thermal conversion layer 2, and is normally composed of a transparent plastic coating.

The above-mentioned conventional reversible heat-sensitive paper 4 (leuco-based rewritable heat-sensitive paper) has the following problems.

(1) The life of an opto-thermal conversion substance used as an opto-thermal conversion layer 2 is so short that if the layer is placed at a bright location for several days (for instance, two or three days), the opto-thermal conversion substance is decomposed, resulting in a shorter life for the reversible heat-sensitive paper. In addition, intense light is required because the reversible heat-sensitive recording layer 2 (an electron donative dyestuff precursor and a reversible developer) must be heated and melted.

(2) When laser light is used to heat the opto-thermal conversion layer 2, a line smaller than the spot diameter of the laser light cannot be written. Consequently, the amount of information is limited when the layer is used to write barcodes, for example.

(3) A conventional writing process is based on so-called raster scanning by scanning lines, therefore, when information spreads two-dimensionally, in the case of letters or two-dimensional barcodes, a long writing time is required.

SUMMARY OF THE INVENTION

The present invention has been achieved to solve the aforementioned problems. The object of the present invention is to provide a reversible heat-sensitive paper (1) the life of which is long and can be written on with a feeble light source, (2) into which a line smaller than a light flux used (for example, a spot diameter of laser light) can be written, thereby, the amount of information in, for instance, barcodes, etc., can be increased, and (3) into which two-dimensional information can be written within a short time, and methods for writing such information as described above.

To achieve the first object (1), the present invention offers a reversible heat-sensitive paper comprising a reversible heat-sensitive recording layer that colors and uncolors its surface by controlling the changing speed of temperature and/or keeping temperature, and the reversible heat-sensitive recording layer being kept to a solid colored state. The reversible heat-sensitive recording layer comprises an electron donative dyestuff precursor and a reversible developer that colors and uncolors the electron donative precursor, and the reversible heat-sensitive recording layer being heated to a fused state, in advance, and then quickly cooled to a solid colored state. In addition, the present invention discloses methods for writing information on reversible heat-sensitive paper, where the reversible heat-sensitive recording layer is heated to a color-erasing temperature lower than the melting temperature, thereby, the layer is uncolored before use, and then information is written on the layer.

These reversible heat-sensitive paper and methods for writing information are characterized in that all of the surface of the paper is previously conditioned into a solid coloring state, and is partially uncolored to write information. In the remainder of the text, these methods are called "reversible writing methods" and the reversible heat-sensitive paper for reversible writing is called "reversible writing heat-sensitive paper."

In the reversible writing methods, the entire surface of reversible heat-sensitive paper (reversible writing heat-sensitive paper) is in a coloring state, by which newly written parts are uncolored. Therefore, the methods are especially suitable for creating a negative image, however, the methods can also apply to producing a positive image. Through these means, the coloring matter of reversible writing heat-sensitive paper is in the state of a solid color and can highly absorb light. Once it absorbs light, its temperature easily increases. Therefore, a conventional opto-thermal conversion layer with a short life can be omitted, so the life of the entire reversible heat-sensitive paper can be prolonged. In addition, the paper can be written on with a weak light source (for instance, using small-output laser equipment), because the paper needs to be heated only within the range of color-erasing temperature, which is lower than the melting temperature.

In addition, to achieve the second object (2), the present invention provides methods of writing information on reversible heat-sensitive paper, in which the reversible heat-sensitive paper with a reversible heat-sensitive recording layer made from an electron donative dyestuff precursor and a reversible developer that can color and uncolor the aforementioned electron donative dyestuff precursor, formed on a base material, is irradiated with light to heat parts of the layer until the reversible heat-sensitive recording layer is molten, and then the layer is cooled quickly and the colored parts are irradiated with light partially in superposition, and the doubled parts are maintained at a predetermined uncoloring range of temperatures, that is lower than the melting temperature for a predetermined time, thus making the parts uncolored.

According to these methods, light (for instance, laser light) is irradiated to quickly cool and color parts, locally in superposition, and doubled parts are maintained within a color-erasing range of temperatures, that are lower than the melting temperature, thereby the color of such parts is erased, therefore, the doubled parts can be turned into a color-erased state, and non-doubled parts can be made into an ordinary state of coloring. Consequently, the width of a line in single parts can be made smaller than a light flux used (for example, the spot diameter of laser light), so the amount of information such as that in barcodes can be sharply increased.

Furthermore, to achieve the third object (3), the present invention presents methods for writing information on reversible heat-sensitive paper, in which a light exposing mask is positioned between a light source and the reversible heat-sensitive paper, and by focusing light transmitted through the mask on the reversible heat-sensitive paper to write two-dimensional information.

According to these methods, two-dimensional information can be written instantly simultaneously, so the time for writing two-dimensional information can be greatly reduced.

The reversible heat-sensitive recording material used in the present invention contains an electron donative dyestuff precursor and a reversible developer that colors the aforementioned electron donative dyestuff precursor, as the main constituents. A compound that is publicly known to be generally applicable to pressure-sensitive recording paper, heat-sensitive recording paper, etc. can be used as an electron donative dyestuff precursor, without any particular restrictions. In addition, the preferred reversible developer is an electron donative compound such as organic phosphonate compound, α-hydroxy aliphatic carboxylate, aliphatic dicarboxylate, and alkylthiophenol, alkyloxyphenol, alkylcarbamoylphenol, or alkylgallate, with a carbon number of 12 or more. However, there are no particular restrictions provided the developer can reversibly change color tone. In addition, the compounds described in the laid-open Japanese patent No. 210954/1994, unexamined Japanese patent applications Nos. 160547/1993; 256825/1993; 317555/1993; 328101/1993; and 10310/1994 are especially preferred.

The other objects and advantages of the present invention are clarified through the following description referring to the attached drawings.

DESCRIPTION OF PREFERRED EMBODIMENTS

Figure 1:
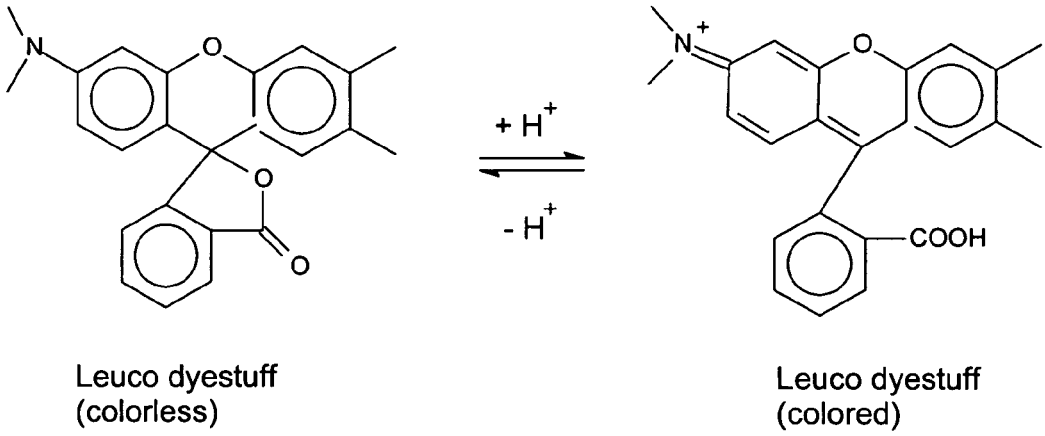
FIG. 1 is a view for describing coloring and uncoloring of a reversible heat-sensitive recording material.
Figure 2:
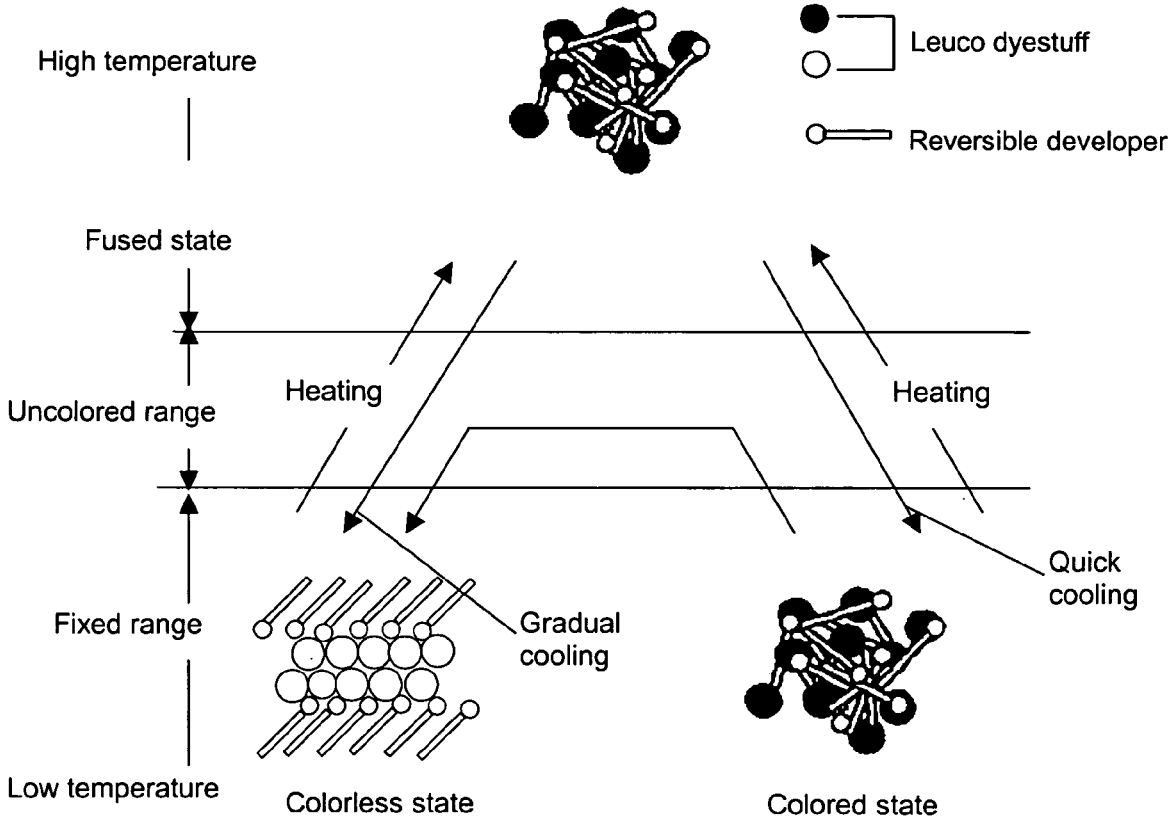
FIG. 2 shows a model of coloring and uncoloring of a reversible heat-sensitive recording material.

Preferred embodiments of the present invention are described below referring to the drawings. The same code numbers are used in all drawings for the same parts, and no duplicate description is given.

Figure 4:
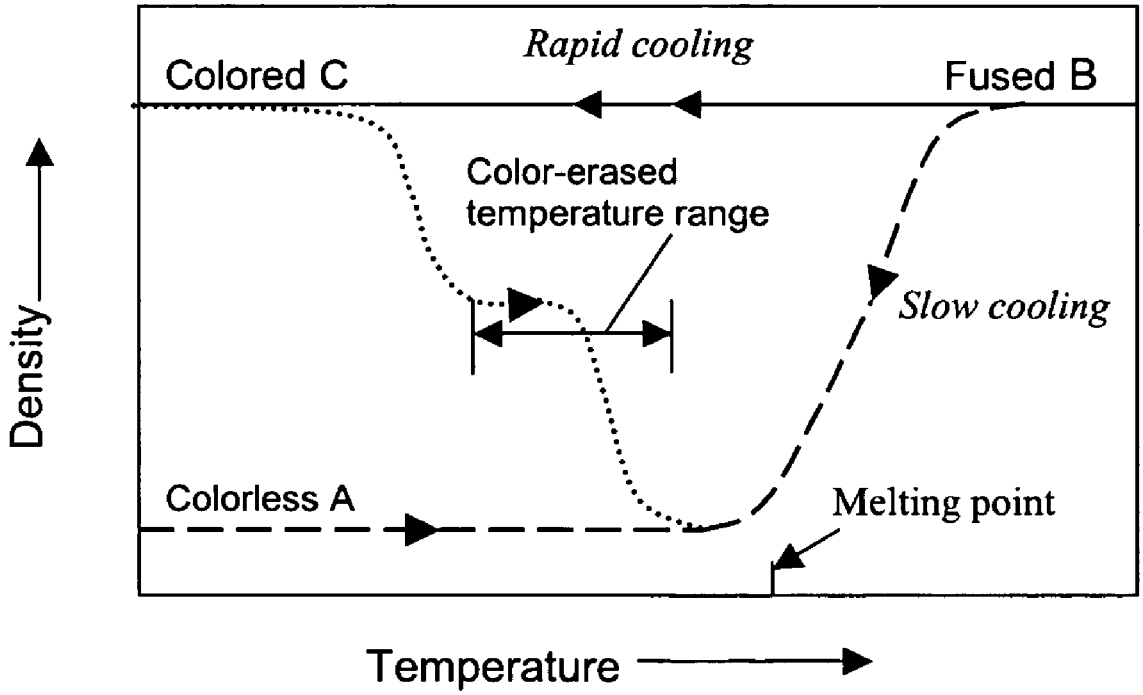
FIG. 4 is a view describing the characteristics of the reversible heat-sensitive paper used in the present invention.

FIG. 4 describes characteristics of the reversible heat-sensitive paper used in the present invention. In FIG. 4, the abscissa and the ordinate are axes for temperatures and coloring densities, respectively. As shown by the arrows in this view, when the reversible heat-sensitive recording layer (for instance, composed of an electron donative dyestuff precursor and a reversible developer) in the color erased state (A) is heated, the precursor and the developer are fused together into the colored state (B), and when the mix is quickly cooled, the mix is solidified in a state close to fusion, thus the mix is maintained in a solid colored state (C). Conversely, if the mix is gradually cooled from the fused state (B), the precursor and the developer are separated in phase and return to the original color-erased state (A).

When the mix is maintained in the solid colored state (C) at a temperature in a range slightly lower than the melting temperature, the mix transits to the original color-erased state (A). This range of temperature (slightly lower than the melting temperature) is called the "color-erasing temperature range."

Figure 5A:
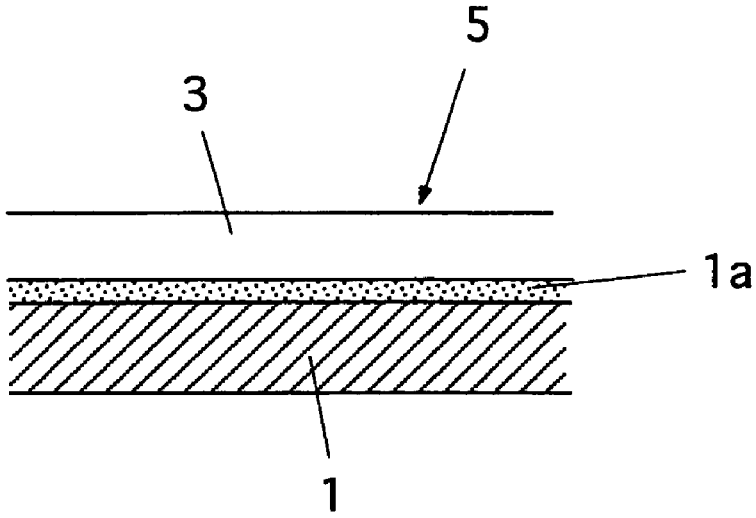
FIG. 5A shows the reversible heat-sensitive paper according to the first embodiment of the present invention (reversible writing heat-sensitive paper)
Figure 5B:
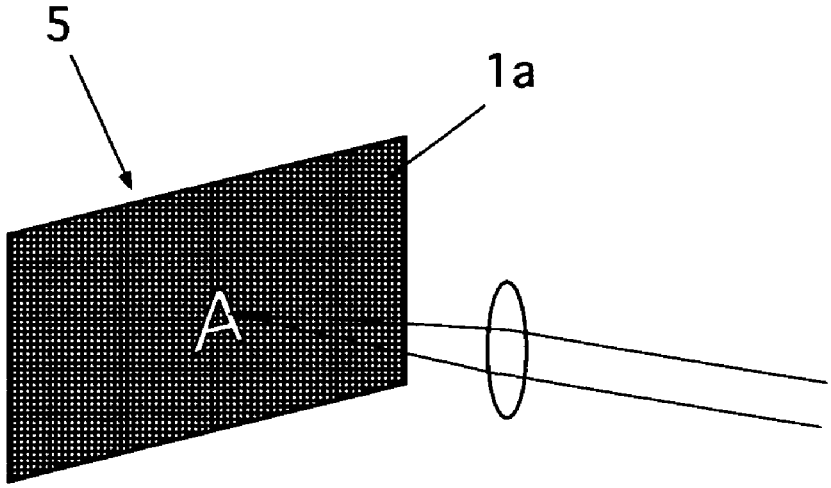
FIG. 5B illustrates methods for writing information according to the first embodiment of the invention (reversible writing methods).

FIGS. 5A and 5B show the reversible heat-sensitive paper (reversible writing heat-sensitive paper) and information writing methods (reversible writing methods), respectively, according to the first embodiment of the present invention.

Figure 3:
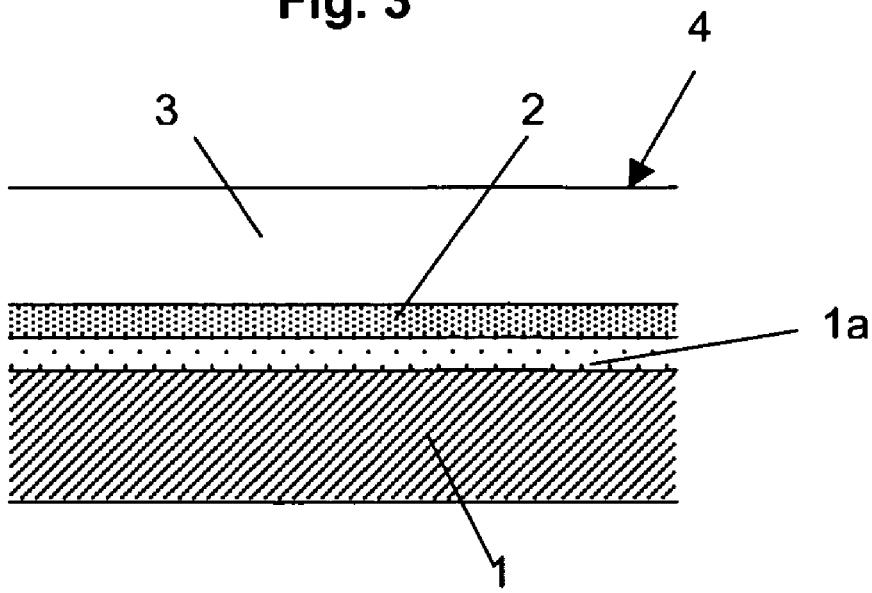
FIG. 3 is a sketch of a sectional view of a conventional reversible heat-sensitive paper.

In FIG. 5A, the reversible heat-sensitive paper according to the present invention (reversible writing heat sensitive paper) is provided with, for instance, an electron donative dyestuff precursor and a reversible color developer, and acts as a reversible heat-sensitive paper 5 provided with a reversible heat-sensitive recording layer 1*a* whose color changes depending on whether the layer is quickly or gradually cooled after it is heated. This reversible heat-sensitive paper 5 does not incorporate a conventional opto-thermal conversion layer (see FIG. 3), and instead, the reversible heat-sensitive recording layer 1*a* is previously heated to a fused state and then is quickly cooled to a solid colored state. This reversible heat-sensitive paper 5 does not need an opto-thermal conversion layer 2. This is because the coloring matter of the reversible heat-sensitive recording layer 1*a* in a solid colored state is so dense that it absorbs and generates heat. A protection film 3 shown in FIG. 3 is to be installed preferably to protect the reversible heat-sensitive recording layer 1*a*, but the film is not indispensable.

According to the information writing methods of the present invention (reversible writing methods) shown in FIG. 5B, the reversible heat-sensitive paper 5 without an opto-thermal conversion layer (reversible writing heat-sensitive paper) is used, and during operation, the reversible heat-sensitive recording layer 1*a* is heated to a color-erasing temperature range lower than the melting temperature, and necessary parts are set to a color-erased state, and information is written on such parts. As the heat source used for writing, a light source that emits light with a wavelength, that can be absorbed easily by the reversible heat-sensitive recording layer 1*a* in a solid colored state (called an absorptive wavelength), such as laser light source generating laser light with an absorptive wavelength is preferred. At that time, the intensity of the laser light should be adjusted appropriately according to characteristics of the reversible heat-sensitive paper to be used.

More explicitly, the above-mentioned means can write information by setting the entire surface in a solid colored state (C in FIG. 4), beforehand, and by uncoloring parts of the surface during operation. Newly written parts are uncolored, therefore, the means are suitable directly for producing a negative image. However, by irradiating the means so as to leave necessary parts, a positive image can also be created, as in a conventional system. In the means, as described above, the coloring matter in a solid colored state absorbs light and generates heat, therefore, a conventional opto-thermal conversion layer with a short life can be omitted, so the life of the entire reversible heat-sensitive paper can be prolonged. Moreover, when writing, the means needs to be heated only to a color-erasing temperature range lower than the melting temperature, so the means can be written with a weak light source (for instance, using laser equipment with a small output).

Figure 6A:
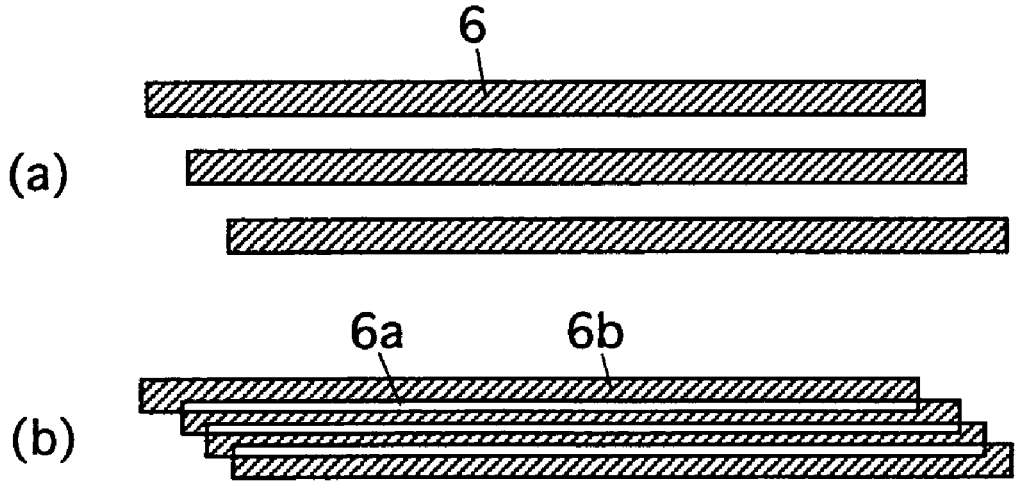
FIG. 6A is a sketch of test results in the second embodiment of the present invention.
Figure 6B:
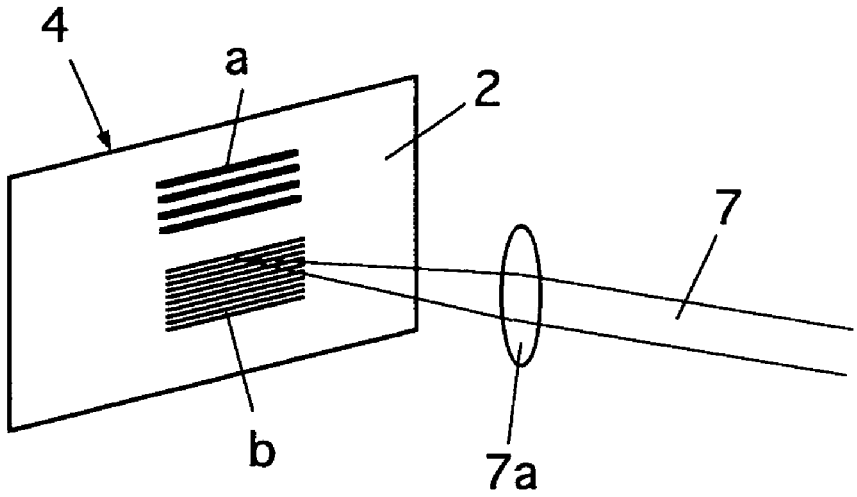
FIG. 6B shows information writing methods according to the second embodiment of the invention (erasing methods).

FIGS. 6A and 6B show a sketch of test results and information-writing methods (writing-erasing methods) of the second embodiment of the present invention, respectively.

FIG. 6A is a conceptual view showing test results when the reversible heat-sensitive paper 4 in FIG. 3 is irradiated with a fine laser light to color the paper. In FIG. 6A, (a) and (b) relate to irradiations at intervals to isolate traces of laser light and with partial superimpositions, respectively.

In (a) in FIG. 6A, thick lines 6 with a width substantially same as the spot diameter of laser light (about 50 μm) are colored. In (b), doubled parts 6*a* return to the color-erased state, as a result, it is revealed that the width of written lines 6 is smaller than the spot diameter of laser light. In other words, in the case of (b), single parts 6*b* are heated in the same way as with the thick lines 6 in (a), allowed to stand naturally after heating, and then are quickly cooled by the atmosphere to shift to a colored state. Conversely, colored portions of doubled parts 6*a* quickly cooled are reheated, therefore, the temperature of the portions was maintained in the above-mentioned color-erasing temperature range for a predetermined time. As a consequence, it might be subjected to gradual cooling as shown in FIG. 4, and the portions might return to an erased state.

The methods of the present invention shown in FIG. 6B are achieved based on novel knowledge obtained from the test results in FIG. 6A. The methods are called "writing erasing methods" in the following paragraphs.

According to the invented methods (writing erasing methods), light is irradiated to heat parts in which the reversible heat sensitive recording layer 2 is heated to a fused state, then quickly cooled to color the parts on which light is irradiated in superimposition, and portions illuminated in superimposition are maintained at a color-erasing temperature range lower than the melting temperature for a predetermined time to uncolor the portions.

As a light source for emitting light with an absorptive wavelength, laser light 7 may be used preferably, but the present invention is not restricted only to this means and may use another light source. When a laser light source is used as shown in the example in FIG. 6A, beams of laser light are shifted slightly toward each other in the horizontal direction of the view, to clearly show the situation, and such shifting is not needed in practice, as a matter of course. In addition, in FIG. 6B, laser light 7 is focused onto the opto-thermal conversion layer 2 using an optical system 7*a* (convex lens etc.), however, fine beams of laser light 7 can be irradiated directly.

According to the aforementioned methods of the present invention (writing erasing methods), light (for instance, laser light) is irradiated to parts that have been colored by quick cooling, partially in superimposition, and doubled portions 6*a* are maintained in a color-erasing temperature range, that is lower than the melting temperature, for a predetermined time to uncolor such portions, so the doubled portions 6*a* can be uncolored, and single portions 6*a* can be colored in a normal state. Therefore, the width of a line in the single portions 6*a* can be made smaller than the light flux used (for example, spot diameter of laser light), thereby, the amount of information on a barcode can be increased dramatically.

Figure 7A:
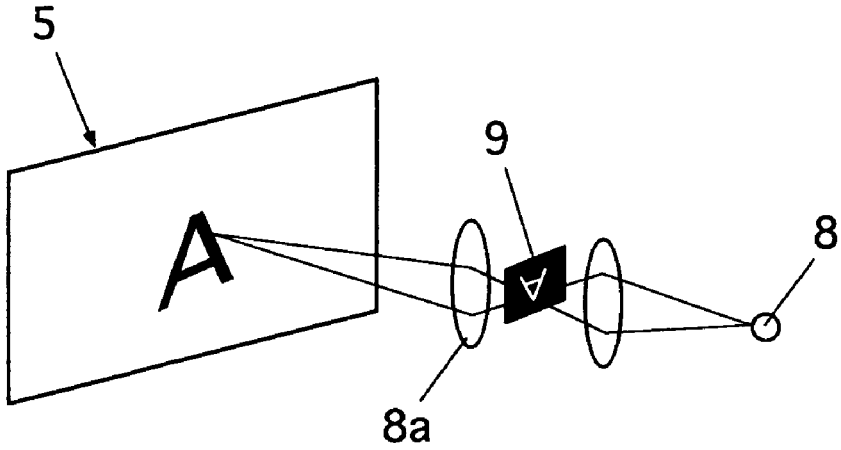
FIG. 7A shows methods for writing information according to the third embodiment of the present invention.
Figure 7B:
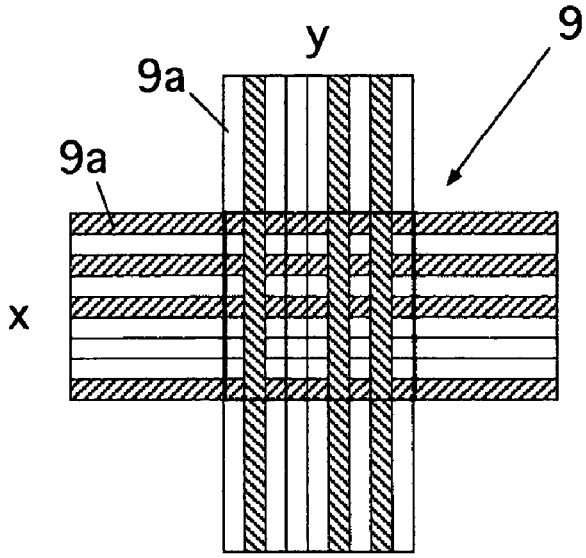
FIG. 7B is a sketch of a mechanical mask used in these methods.

FIGS. 7A and 7B show the information-writing methods and a sketch of the mechanical mask used in the methods, according to the third embodiment of the present invention.

As typically shown in FIG. 7A, according to the methods of the present invention, an exposing mask 9 with an information content is positioned between a light source 8 and reversible heat sensitive paper 5, and light transmitted through the exposing mask 9 is focused on the reversible heat-sensitive paper to write two-dimensional information. These methods are called "all surface simultaneous writing methods."

As a light source 8 used in the all surface simultaneous writing methods (two-dimensional writing), a pulse light source such as a flash lamp may preferably be used.

To color the entire surface as a pre-stage of reversible lighting, one-dimensional scanning using a heater or an incandescent lamp is carried out for heating in a straight line (for instance, a vertically spread light source is moved from left to right), or a flash light source is used to instantly heat the entire surface for coloring. If cooling rate is insufficient, an air-cooling mechanism may preferably be added.

To erase the entire surface, a heater, incandescent lamp or flash light source is used to heat the entire surface instantaneously, thereby, the entire surface is uncolored. Or, hot air etc. may also be blown.

Mechanisms for coloring and uncoloring the entire surface are substantially the same, and are controlled by heating temperature (a low temperature gives rise to uncoloring) or cooling rate (a long heating time may heat the layer more deeply down to the supporting base, resulting substantially in gradual cooling).

As the exposing mask 9, some optical gates, such as a mechanical mask, optical mask, liquid crystal, movable mirror, etc. can be used. FIG. 7B shows an example of the mechanical mask; a plurality of shutter belts 9*a* are provided in orthogonal x and y directions, and each belt is independently opened and closed using an actuator, not illustrated, thus, a free transmission pattern can be formed. When a liquid crystal is used as the exposing mask 9, transmission of light is controlled two-dimensionally.

By irradiating this exposing mask 9 with an intense light source 8 and focusing the image of the exposing mask 9 on recording paper using an appropriate optical system 8*a*, the preferred portions can be heated. According to these methods (simultaneous writing methods for the entire surface), two-dimensional information can be written simultaneously, so that time for writing two-dimensional information can be greatly reduced.

In addition, in the case of one-dimensional writing, raster scanning in which laser light is scanned on recording paper can be applied, as well as vector scanning for controlling laser light two-dimensionally to write information onto recording paper.

As described above, the reversible heat-sensitive paper and methods for writing information on the paper according to the present invention provide the following effects.

1) Using "reversible writing heat-sensitive paper" and "reversible writing methods," the entire surface is conditioned to a solid colored state, beforehand, and the surface is partially uncolored during operation to write information. Therefore, a conventionally used opto-thermal conversion layer with a short life can be omitted, taking advantage of the opto-thermal conversion characteristics of the solid colored state, and the life of the entire reversible heat-sensitive paper can be prolonged. In addition, because the paper is required to be heated almost to a color-erasing temperature range, which is lower than the melting temperature, writing can be achieved using a weak light source (for instance, laser equipment with a small output).

(2) According to the "writing erasing methods," the width of a line of single parts can be made smaller than a light flux used (for example, spot diameter of laser light), therefore, the amount of information on a barcode etc. can be sharply increased.

(3) The "all surface simultaneous writing methods" enable simultaneous writing of two-dimensional information within a short period, resulting in a great reduction in the time for writing two-dimensional information.

In summary, the reversible heat-sensitive paper and the methods for writing information on the paper according to the present invention provide (1) longer life for the reversible heat-sensitive paper and writing with a weak light source, (2) lighting using a finer line than a light flux used (for instance, spot diameter of laser light), and a greater amount of information on a barcode etc., and (3) simultaneous, short-time writing of two-dimensional information, as desirable effects.

Although the present invention has been described referring to a number of preferred embodiments, it should be understood that the scope of rights contained in the invention is not limited only to these embodiments. Conversely, the scope of rights of the invention includes all improvements, modifications, and similar entities covered by the scope of the attached claims.

What is claimed is:

1. A method of writing information on a reversible heat-sensitive paper, comprising the steps of:

preparing a reversible heat-sensitive paper comprising a reversible heat-sensitive layer that comprises an electron donative dyestuff precursor and a phenol-based compound with long chains in the alkyl group as a reversible developer that colors and uncolors the electron donative precursor, by heating the reversible heat sensitive layer to a molten state and then quickly cooling to a solid colored state; and heating a part of the reversible heat-sensitive recording layer to a color-erasing temperature range that is lower than the melting temperature of the reversible heat sensitive recording layer, wherein the part is uncolored and stores the information.

2. A method of writing information on a reversible heat-sensitive paper comprising the steps of:

preparing the reversible heat-sensitive paper comprising a reversible heat-sensitive recording layer that comprises an electron donative precursor and a phenol-based compound with long chains in the alkyl group as a reversible developer that colors and uncolored the electron donative precursor, formed on a supporting base;

irradiating the reversible heat-sensitive paper with light;

heating an irradiated part so that the reversible heat-sensitive recording layer is heated to a molten state, then quickly cooling the irradiated part to produce a colored portion; and irradiating the colored portion with light partially in superimposition to produce a double irradiated portion, and uncoloring the doubled irradiated portion by maintaining the portion in a color-erasing temperature range that is lower than the melting temperature of the reversible hear-sensitive recording layer, for a predetermined time.

3. A method of writing information on a reversible heat-sensitive paper, comprising the steps of:

providing a reversible heat-sensitive paper comprising a reversible heat-sensitive recording layer that comprises an electron donative precursor and a phenol-based compound with long chains in the alkyl group as a reversible developer that colors and uncolors the electron donative precursor, formed on a supporting base;

irradiating the reversible heat-sensitive paper with light to heat the paper; and cooling a portion of the paper at a sufficiently fast rate to produce a colored portion while substantially maintaining coloring density of the reversible heat sensitive paper.

4. A method of writing information on a reversible heat-sensitive paper, comprising the steps of:

providing a reversible heat-sensitive paper comprising a reversible heat-sensitive recording layer that comprises an electron donative precursor and a phenol-based compound with long chains in the alkyl group as a reversible developer that colors and uncolors the electron donative precursor, formed on a supporting base;

irradiating the reversible heat-sensitive paper with light to heat the paper;

cooling a first portion of the paper at a relatively slow rate to produce an uncolored portion; and cooling a second portion of the paper at a relatively faster rate to produce a colored portion.

* * * * *